US005181507A

United States Patent [19]

Michel et al.

[11] Patent Number: 5,181,507

[45] Date of Patent: Jan. 26, 1993

[54] AIR PURIFYING RESPIRATOR SUSPENSION

[75] Inventors: M. John Michel, Coatesville; Frederick D. Snyder, Breinigsville; Venkateswara R. Emany, Sinking Spring, all of Pa.

[73] Assignee: WGM Safety Corp., Reading, Pa.

[21] Appl. No.: 782,394

[22] Filed: Oct. 25, 1991

[51] Int. Cl.[5] ..... A62B 7/00

[52] U.S. Cl. ..... 128/201.25; 128/206.17; 128/206.27; 128/207.11

[58] Field of Search ..... 128/201.22, 201.23, 128/201.25, 206.12, 206.15, 206.16, 207.11, 206.17, 206.21, 206.27, 206.28, 201.15, 206.23, 206.24; 2/9, 6

[56] References Cited

U.S. PATENT DOCUMENTS

| | | | |
|---|---|---|---|
| 1,710,160 | 4/1929 | Gibbs | 128/206.24 |
| 2,341,566 | 2/1944 | Monro | 128/206.24 |
| 2,444,417 | 7/1948 | Bierman | 128/206.24 |
| 2,505,173 | 4/1950 | Conley | 128/206.17 X |
| 2,625,155 | 1/1953 | Engelder | 128/206.24 |
| 2,821,192 | 1/1958 | Monro | 128/201.25 X |
| 2,912,978 | 11/1959 | Seeler | 128/201.23 |
| 3,040,741 | 6/1962 | Carolan . | |
| 3,599,635 | 8/1971 | Ansite | 128/207.11 X |
| 3,833,935 | 9/1974 | Ansite et al. | 2/6 |
| 4,179,274 | 12/1979 | Moon | 128/206.17 X |
| 4,207,882 | 6/1980 | Lemere | 2/9 X |
| 4,402,316 | 9/1983 | Gadberry | 128/206.21 X |
| 4,414,973 | 11/1983 | Matheson et al. . | |
| 4,595,003 | 6/1986 | Shoemaker et al. | 128/201.25 X |
| 4,850,346 | 7/1989 | Michel et al. . | |
| 4,960,121 | 10/1990 | Nelson et al. | 128/206.27 X |
| 5,062,421 | 11/1991 | Burns et al. | 128/206.17 X |

FOREIGN PATENT DOCUMENTS

| | | | |
|---|---|---|---|
| 307728 | 11/1919 | Fed. Rep. of Germany | 128/206.17 |
| 838138 | 2/1939 | France | 128/201.25 |
| 157888 | 1/1969 | U.S.S.R. | 128/206.15 |
| 555668 | 9/1943 | United Kingdom | 128/206.15 |
| 880942 | 10/1961 | United Kingdom | 128/206.17 |

OTHER PUBLICATIONS

North Catalog No. RP-110 date Mar. 1984 entitled Air-Purifying Respirator (especially p. 7).

*Primary Examiner*—V. Millin
*Assistant Examiner*—Sebastiano Passaniti
*Attorney, Agent, or Firm*—Synnestvedt & Lechner

[57] ABSTRACT

A respirator suspension system is disclosed. A face mask for covering the mouth and nasal passages of the user has a peripheral sealing portion for establishing a seal with the user's face and filter cartridges disposed in air inlet passage on either side of the face mask. The cartridges are provided with guide fittings and guide surfaces for support and guiding of a single adjusting strap which interconnects a crown support with the face mask. In accordance with the disclosure, the crown support comprises a first precurved member extending over the top of the head of the user and a second precurved member integrally joined to the first which fits around the back of the head of the user. The elastic strap extends from a juncture portion of the two strap members on one side of the head of the user, around the front of the filter cartridge on said one side of the head of the user, around the back of the neck of the user and then around the other filter cartridge and then through an adjustable strap catch on the juncture member on the other side of the head of the user. A pull on the end of the strap effects adjustment of the respirator into a position in which it seals with the face of the user.

24 Claims, 2 Drawing Sheets

FIG. 4
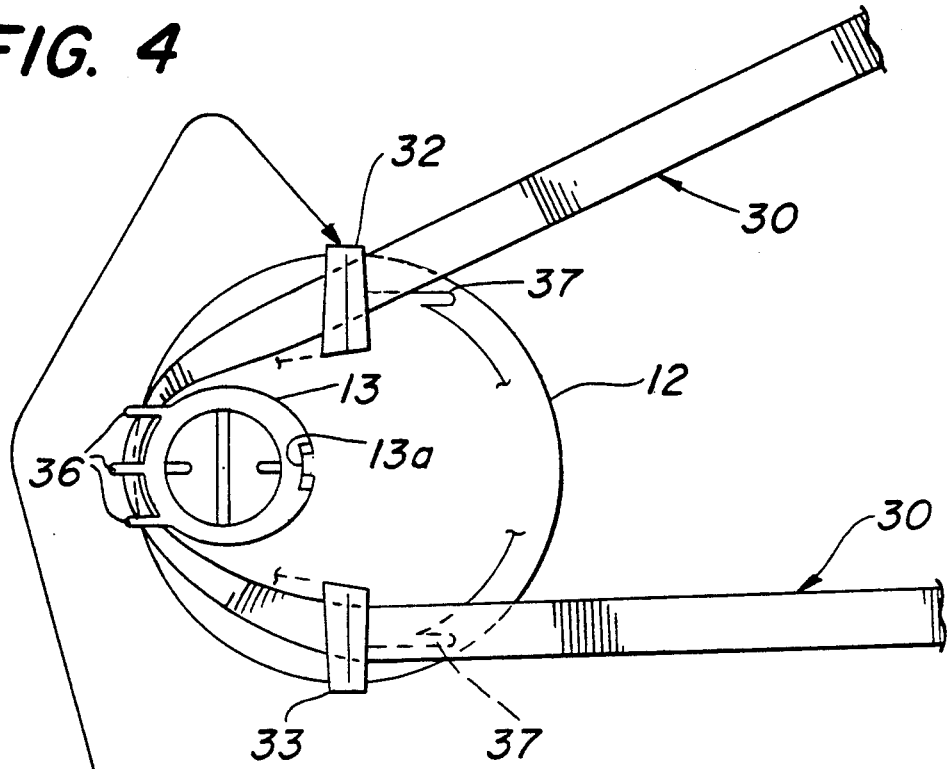
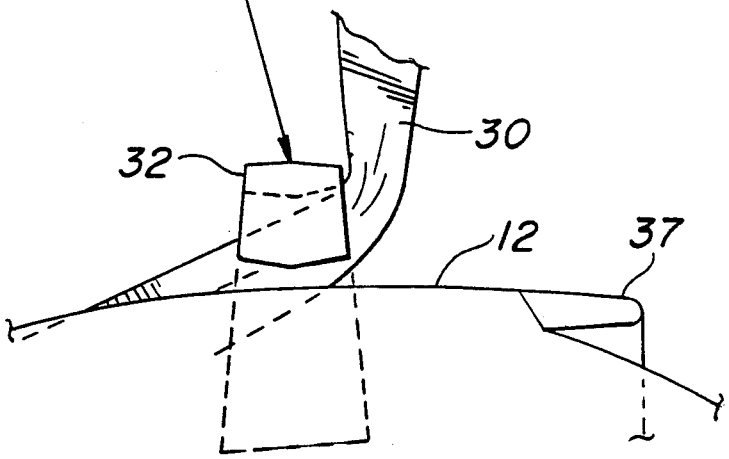
FIG. 5b
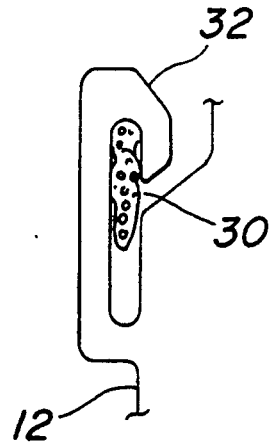
FIG. 5a

AIR PURIFYING RESPIRATOR SUSPENSION

FIELD OF THE INVENTION

This invention relates to air purifying respirators in general and in particular to a sliding suspension which facilitates donning, distributes weight evenly and overall balances the respirator in a more comfortable fashion on the face of the user.

BACKGROUND AND THE PRIOR ART

Respirators of the kind referred to are generally termed half-mask respirators and comprises a face mask formed of silicon or natural rubber covering the mouth and nasal passages of the user. Relatively large, heavy filter cartridges are usually disposed on the sides of the mask and are mounted on mask parts which house inhalation valves. Important criteria in the design of such respirators is that they are easy to don and adjust, that a reliable seal is provided between the mask and the face of the user, despite various facial configurations, and that they are nicely balanced and reasonably comfortable so that they can be used over a prolonged period of time. In addition, half-mask respirators of the kind described need to be compatible with protective eyewear and, in some cases, should be able to be integrated with a protective eye shield so that one unit affords protection from hazards to the eyes as well as providing protection from airborne vapors and particulates. A typical respirator of the kind referred to is found in U.S. Pat. No. 4,414,973, dated Nov. 15, 1983. The half-mask respirator disclosed in this patent provides upper and lower pairs of straps which are connected to the respirator by means of four spaced apart buttons which retain eyelets affixed to the ends of each of the pairs of straps. Both the upper and lower straps have independent adjustment means. The ends of the upper straps are interconnected by means of a hook-and-eyelet configuration which is apparently provided for the lower strap as well. The arrangement is somewhat awkward and is time consuming to adjust. If the upper straps slip from position on the user's head, the seal with the face can be readily broken.

U.S. Pat. No. 4,850,346, dated Jul. 25, 1989, discloses a respirator suspension system involving a crown strap comprising pairs of interconnected crown strap members joined together by junction pieces adjacent the side of the head with upper and lower side straps interconnected to the respirator by a yoke member. Although this arrangement provides a vast improvement in terms of comfort to the wearer and the maintenance of a good seal with the wearer's face, adjustment of the suspension by the individual is time consuming and is somewhat complicated and expensive to manufacture.

U.S. Pat. No. 3,040,741, dated Jun. 26, 1962, discloses a quick donning harness for an oxygen mask. This arrangement employs crown strap members which require independent adjustment through means of set screws and rely on coil springs to bias the mask onto the wearer's face. Although the mask assembly may be quickly donned once it is properly adjusted, initial adjustment is time consuming, and the arrangement is complicated and expensive. A separate neck strap is provided which is connected to the respirator by means of quick connect or snap fasteners, but this neck strap is apparently only used for suspending the mask around the user's neck when oxygen is not required.

SUMMARY AND OBJECTS OF THE INVENTION

In summary, the invention provides a support for the respirator on the head of the wearer comprised of two crown strap members configured to conform to the shape of the top and of the back of the head of the user, the two strap members being joined to juncture pieces adjacent the side of the wearer's head to form an integral unitary assembly. Preferably, the crown strap assembly comprising the juncture piece and the two strap members are molded together in unitary fashion from a flexible and resilient lightweight material. The crown assembly supports a half-mask respirator having a sealing surface formed of silicon rubber or other soft and flexible material. A single strap, which is preferably resilient, extends from the juncture piece on one side of the head of the user to the face mask and from the face mask around the neck of the user to the other side of the face mask and from there to the juncture piece of the other side of the user. An adjustable catch means on the juncture piece holds the strap in an adjusted position. When the crown piece is placed on the head of the user with the strap extending behind the neck of the user, an outward and downward pull of the respirator strap through the resilient catch assembly pulls the mask upwardly and rearwardly into sealing relationship with the face of the user.

With the foregoing in view, it is an important object of the present invention to provide a respirator suspension system which may be donned and made functional using one hand of the wearer with a pull of the adjusting strap.

It is a further objective of the invention to provide an adjustable suspension system for a respirator or the like which provides for extremely rapid deployment of the respirator by a hand pull of a single adjusting strap.

A further important objective of the invention is the provision of a suspension system which holds the respirator face mask securely and comfortably in sealing engagement on the user's face.

A still further objective of the invention is the provision of a respirator suspension system which accommodates persons of a wide range of face sizes and configurations.

A still further objection of the invention is a provision of a suspension system which is comfortable and well balanced, thereby allowing for use of the respirator over prolonged periods of time.

Another object of the invention is the provision of guide means formed integrally with the respirator inlet air filter cartridges for guiding and supporting a respirator suspension strap.

Another objective of the invention is the provision of air filter cartridges of novel design having symmetrically located suspension system support and guide means, the cartridges being configured for use alternatively in a right or left hand air inlet port of the face mask.

Other objects and advantages of the invention will become apparent upon reference to the following detailed description of the preferred embodiment of the invention, which is explained in reference to the accompanying drawings.

DETAILED DESCRIPTION OF THE DRAWINGS

FIG. 4 is a diagrammatic view of the filter cartridge configuration facing outwardly from the face mask and incorporating a preferred form of suspension strap means of the present invention; and FIG. 5*a* and 5*b* are detailed views of the guide loops illustrating various strap positions.

DESCRIPTION OF THE PREFERRED EMBODIMENT OF THE INVENTION

Figure 1:
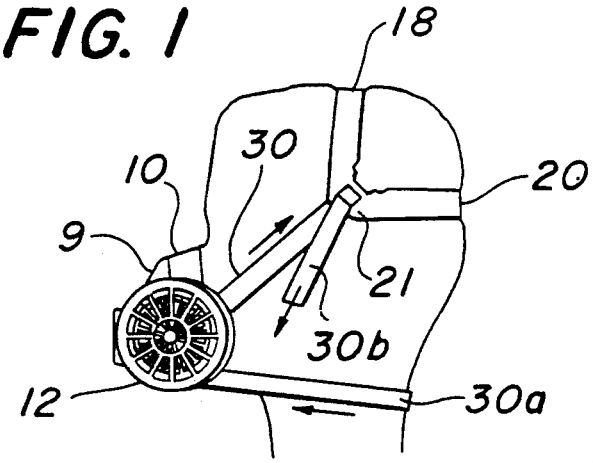
FIG. 1 is a side profile, schematic view of a respirator suspension system incorporating the principles of the invention.
Figure 3:
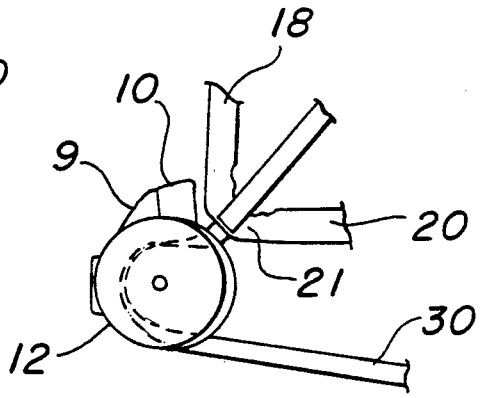
FIG. 3 is a side profile view somewhat similar to FIG. 1 but illustrating the respirator prior to donning.
Figure 2:
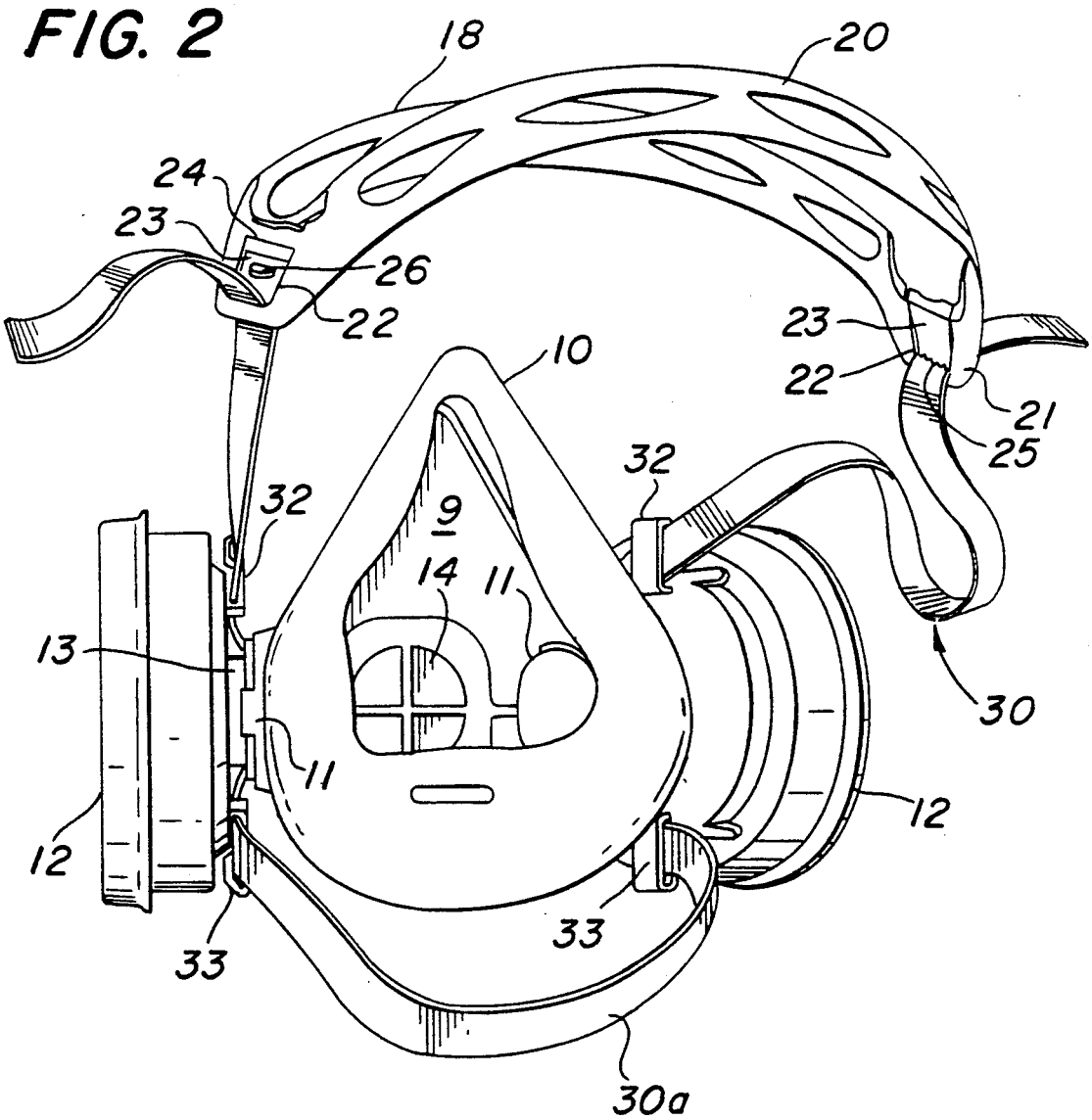
FIG. 2 is a perspective rear view in enlarged form with respect to FIG. 1, illustrating the respirator and respirator suspension system.

As can be best seen upon reference to FIGS. 1 through 3, a half-mask respirator is illustrated which comprises a rigid face mask piece 9 formed of a material, such as polyethylene, and having a sealing surface of a soft, pliable, resilient material as illustrated at 10 which is joined thereto and is intended to provide a seal with the face of the user in the area of the face extending over the bridge of the nose, around the sides of the nose and mouth regions when protection from atmospheric contaminants, such as paint vapors, chemical fumes or airborne particulates is required. The sealing material may be a thermoplastic or a thermosetting resin. Although other materials may be employed, a styrene block copolymer manufactured by GLS Plastics, 10666 Dieckman Road, Woodstock, Ill. 60098 has been found to produce excellent results. Face masks of the kind described include inlet passages or ports 11 disposed at the sides of the mask. Filter cartridges 12 containing filter media, such as activated carbon and/or filter papers intended to remove airborne particulates are mounted in each inlet port 11. For this purpose, each cartridge is provided with a mounting boss 13 which is preferably mounted in offset relationship with respect to the center of the cartridge. The mounting bosses interfit with integrally molded connectors within the mask and securely position the cartridge so that it sits well back on the face of the user. A notch 13*a* on the cartridge boss interfits with a projection, not shown, on the inside surface of the mask to position the cartridge (FIG. 4).

The face mask is also provided with a centrally located exhalation port 14 which is generally located immediately in front of the nostrils of the user. Port 14 contains an exhalation valve which allows for the exhalation of air from the mask with minimal effort while preventing entrance of air and airborne particulates in a manner known to those of ordinary skill in the art.

The suspension system of the present invention preferably comprises a crown structure consisting of a first crown strap member 18 which is precurved to fit over and conform to the top of the head of the wearer and a second crown strap member 20, precurved to fit over and conform to the back of the head of the wearer, as is best seen upon reference to FIGS. 1 through 3. The two crown members are preferably joined together at the sides of the head of the user by juncture portions 21. Preferably, the juncture portions 21, the top strap member 18 and the back strap member 20 are molded together as one integral, unitary element formed of a resilient plastic material, such as polypropylene. The juncture members also preferably have rectangular openings 22 formed therein in which resilient catches or flaps 23 are provided. Each catch or flap is joined at its upper end to the juncture member by a living hinge indicated at 24 in FIG. 2 and is resiliently biased to a position in which the opening 22 is substantially closed. The lower edge of each catch or flap member 23 is preferably provided with teeth or serrations along edge 25, as indicated in FIG. 2, and each may have a small projecting tab 26 which serves as a handle which may be moved by a thumbnail of the user to flex the catch from its closed position to an open position for reasons which can be readily understood below.

The crown strap assembly is interconnected to the face mask in the following fashion. A single strap 30, preferably formed of elastic fabric material, is threaded through the opening 22 in one of the juncture portions by opening the catch 23 and passing the strap end therethrough. The catch is then released so that the strap end is securely locked in place. The strap is connected to the face mask by means of upper and lower guide loops 32 and 33 which are preferably integrally molded into the surface of each cartridge which faces the face mask 10. The elastic strap 30 is passed through the upper guide loop 32 on the cartridge on one side of the face of the wearer, around the front of the cartridge and then through the bottom loop 33 which is diametrically opposed to the guide loop 32. The strap then passes to the other lower guide loop 33, and from there, in front of the cartridge and then through the space between the catch 23 and the opening in the juncture portion on the other side of the head of the wearer.

Preferably, guide projections 36 integrally molded on the front of the cartridges provide a guide path around the cartridge fronts, preventing the strap from slipping into the relatively narrow space between the cartridge and the mask, as will be seen upon reference to FIG. 4 below.

The position of the upper and lower guide loops 32 and 33 and the guide projections 36 can readily be seen in FIG. 4, a detail of one such guide loop also being shown in FIGS. 5*a* and 5*b*. The symmetrical positioning of the strap guide loops and guide projections and positioning notch 13*a*, as shown in FIG. 4, allows for use of a single form of cartridge, usable in either inhalation port with the strap loops and projections properly oriented irrespective of the port the cartridge is fitted in. At the same time, the bosses are asymmetrically located with respect to the cartridge centers so that the cartridges fit well back towards the user's face.

Preferably, the cartridges are also provided with symmetrically located ribs 37 located rearwardly of the guide loops 32 and 33. The ribs 37 act to urge the elastic strap away from the slot into the hook shaped part of a guide loop when the strap is stretched, thus avoiding accidental movement of the strap out of its loop. The strap in the condition in which it is supporting the weight of the respirator and the relationship of an upper guide loop and guide rib 37 can be seen in FIG. 5*b*.

In donning the respirator, which is shown in the pre-donning configuration in FIG. 3, the crown strap is placed on the wearer's head with the respirator attached by the elastic strap 30, and the strap portion 30*a* is fitted around and behind the wearer's neck. In order to adjust the respirator, the user merely pulls on the end 30*b* of the strap 30 in a line extending diagonally downwardly and forwardly, as shown by arrow 38 in FIG. 1. The strap slips through catch 23 on the side of the assembly adjacent the strap end due to the yieldable nature of the hinge 24, whereas catch 23 on the opposite side of the wearer's head being pulled towards its opening holds the opposite end of the strap firmly in place. The downward and forward movement thus pulls the face mask upwardly and rearwardly in sealing relationship with the wearer's face inasmuch as all slack in the strap is removed. The elastic strap can be stretched to the amount needed to maintain an even sealing pressure on the face. The above adjustment can be accomplished by even an inexperienced user of the device in a matter of a few seconds. If it is desired to relieve the strap pressure, the catch member 23 can be lifted by lifting the projection 26 with the fingernail, allowing the end of the strap 30 to slip through the opening provided.

We claim:

1. In combination with a respirator face mask for covering the mouth and nasal passages of a user and having a peripheral sealing portion for establishing a seal with the facial tissue of the user, a suspension system comprising:

crown suspension means having a first part to extend over the top of the head of the user and a second part to extend around the back of the head of the user, said first and second parts converging in juncture portions at each side of the user's head;

an elastic strap for fastening the face mask to the crown suspension means;

upper and lower strap guide loops on each side of said face mask in fixed relationship thereto, said strap being extendible from said juncture portion on one side of the head of the user through the upper strap guide loop on said one side, then through the upper strap guide loop on said one side, around the back of the user's neck and through the other lower strap guide loop, through the upper strap guide loop on said other side to said other juncture portion; and adjustable securing means on one of said juncture portions for adjustably maintaining a predetermined tension on the elastic strap extended between said juncture portions.

2. A combination according to claim 1, wherein said crown suspension means comprises a unitary molded assembly of flexible resilient plastic material, said assembly including said first and second parts and said junction portions, said first and second parts being precurved to fit over the head of a suer with the junction portions being positioned adjacent the user's temples.

3. A combination according to claim 1, said face mask having air inlet passages disposed on either side of a centrally located air outlet passage and a filter cartridge disposed in each said air inlet passage, each cartridge extending laterally outwardly from the face mask and containing a filter media for purification of air inhaled through the air inlet passages, said strap guide loops being positioned above and below the air inlet passages, said elastic strap extending around the front of the cartridges.

4. A combination according to claim 3, wherein said strap guide loops are affixed to said cartridges.

5. A combination according to claim 4, said cartridge having a first surface having an air inlet passage adapted to face generally away from the face mask for the intake of ambient air and a second surface disposed generally oppositely to the first surface, an air outlet passage in said second surface, a connecting boss on said second surface surrounding each said air outlet passage for connecting the cartridge to one of said face mask air inlet passages, said strap guide loops being affixed to the said second surface of said cartridge in planes passing respectively above and below each said boss.

6. A combination according to claim 5, further including strap guides projecting from said second surfaces forwardly of said bosses for guiding said strap around the front of said bosses.

7. A combination according to claim 6, wherein said boss, said strap guide loops and said strap guides are symmetrically spaced from a line equidistant from the top and the bottom of each of said cartridges.

8. A combination according to claim 7, wherein each said cartridge is substantially cylindrical with the first and second surfaces forming the cylinder ends.

9. A combination according to claim 8, wherein each said boss is located forwardly of a line passing through the center of said second surface.

10. A combination according to claim 9, further including interengageable positioning stop means on said face mask and said cartridge bosses for fixing the rotational orientation of said cartridges relative to the mask.

11. A combination according to claim 10, wherein said adjustable securing means comprises a substantially rectangular opening in said one juncture portion for receiving and passage of an end of said elastic strap, a closure member having a first side hingedly secured to said juncture portion along one side of said opening, said closure member being configured to fit said opening and having a serrated edge opposite to said first side, said closure member being yieldable along said first side to allow opening of the rectangular opening and passage of the elastic strap outwardly through said opening and being moveable to clamp said strap within said opening in adjusted position upon release of tension on the strap.

12. In combination with a respirator face mask for covering the mouth and nasal passages of the user and having a peripheral sealing portion of yieldable material for establishing a seal with the user's face, said mask having a centrally located air outlet passage, air inlet passage s disposed on either side of said centrally located air outlet passage and filter cartridges disposed in said air inlet passages, each cartridge extending from the sides of said face mask and containing a filter media for purification of air inhaled through the air inlet passages, a suspension system comprising:

a crown support adapted for support on the head of the user and having first and second parts extended respectively over the top and the back of the head of the user, said first and second parts converging in junction portions at each side of the usre's head;

an elastic strap extending from one of said junction portions to the other; and adjustable latch means for varying the length of said elastic strap between the junction portions and strap guide means fixedly secured relative to said face mask on opposite sides thereof, the strap being extended from the junction portion on one side of the user's head first through the strap guide means on one side of the face mask, then around the use's neck, next through the guide means on the other side of the face mask and then to the junction portion on the said other side of the user's head, the strap guide means and the juncture portions being relatively positioned for the application by said elastic strap means of a constant upwardly and rearwardly acting mask sealing pressure on the face of the user.

13. A combination according to claim 12, wherein said crown system means comprises a unitary molded assembly of flexible resilient plastic material, said assembly including said first and second parts and said junction portions, said first and second parts being precurved to fit over the head of a user with the junction portions being positioned adjacent the user's temples.

14. A combination according to claim 12, wherein said strap guide means comprises strap guide loops affixed to said cartridges.

15. A combination according to claim 14, each said cartridge having a first surface having an air inlet adapted to face generally away from the face mask for the intake of ambient air and a second surface spaced from the first and disposed generally oppositely to the first surface, an air outlet passage in said second surface, a connecting boss surrounding each said air outlet passage for connecting the cartridge to one of said face mask air inlet passages, said strap guide loops being affixed to said second surface of said cartridge on opposite sides of each said boss.

16. A combination according to claim 15, further including strap guides projecting from said second surface forwardly of said boss.

17. A combination according to claim 16, wherein said boss, said strap guide loops and said strap guides are symmetrically located on lines equidistant from the top and the bottom of each of said cartridges, each said line passing from the cartridge front to the cartridge back.

18. A combination according to claim 17, wherein each said cartridge is substantially cylindrical with the first and second surfaces forming the cylinder ends.

19. A combination according to claim 18, wherein each said boss is located forwardly of a line passing through the center of said second surface and is centered on a second line which is perpendicular to the first line.

20. A combination according to claim 18, further including interengageable positioning stop means on said face mask and said cartridge boss for rotational orientation of the cartridge relative to the mask.

21. A combination according to claim 20, wherein said adjustable securing means comprises a substantially rectangular opening in said one juncture portion for receiving and passage of an end of said elastic strap, a closure member having a first side hingedly secured to said one juncture portion along one side of said opening, said closure member being configured to fit said opening and having a serrated edge opposite to said first said closure member and being yieldable along said first side to allow opening of the rectangular opening and passage of said elastic s trap outwardly through said opening and being moveable to clamp said elastic strap within said opening in adjusted position upon release of tension on said elastic strap.

22. In combination with a respirator face mask for covering the mouth and nasal passages of the user and having a peripheral sealing portion for establishing a seal with the facial tissue of the user circular, said face mask having a centrally located air outlet passage, air inlet passages disposed on either side of said centrally located air outlet passage and symmetrical filter cartridges having an air delivery duct mounted in said air inlet passage, said air delivery duct being centered on a line bisecting the cartridge into upper and lower halves, each cartridge extending laterally outwardly from the face mask and containing a filter media for purification of air inhaled through the air inlet passages;

a suspension system comprising:

a pair of precurved crown strap members, a first of said pair of strap members being configured to extend over the top of the head of a user and the second being configured to extend around the back of the head of the user, each strap member being joined to the other by juncture pieces disposed at the sides of the head of the wearer;

an elastic strap having a first end secured to a first one of said juncture pieces and a second end adapted to be secured to the second of said juncture pieces;

guide means comprising upper and lower strap guide loops mounted on each said filter cartridge at points equidistantly disposed above and below the air inlet passages, the elastic strap being extended from the juncture piece on one side of the head of the user through the upper guide loop on the cartridge on the side of the user's head, around the front of the cartridge and back and through the lower guide loop on the same cartridge, then around the back of the user's neck and then through the lower guide loop of the other cartridge, around the front of the other cartridge and then back through the other upper guide loop; and a catch assembly on the second juncture member comprising an opening provided to receive said elastic strap, a catch flap configured to fill said opening and resiliently disposed to bear against the strap portion extending from the second guide loop of the second cartridge and passing through said opening, said catch flap being yieldable to allow movement of the strap in a direction causing a foreshortening of the strap portion disposed between the first and second juncture pieces and to restrict movement of the strap in the opposite direction.

23. A combination according to claim 22, further including means on said face mask for orienting said guide loops in a substantially vertical plane and each said cartridge extending through the center of said air inlet passages.

24. A combination according to claim 23, further including strap guide projections integrally formed on said cartridges and extending forwardly of the air inlet passages in the region between the face mask and the cartridges.

* * * * *

UNITED STATES PATENT AND TRADEMARK OFFICE

CERTIFICATE OF CORRECTION

PATENT NO. : 5,181,507

DATED : January 26, 1993

INVENTOR(S) : Michel et al

It is certified that error appears in the above-indentified patent and that said Letters Patent is hereby corrected as shown below:

On the title page under the heading "Inventors", the name "M. John Michel" should be --John M. Michel--

Column 5, line 35, "upper" should be --lower--

Column 5, line 50, "suer" should be "user"

Column 6, line 44, "passage s" should be --passages--

Column 6, line 54, "usre's" should be --user's--

Column 6, line 63, "use's" should be --user's--

Column 7, line 57, "s trap" should be --strap--

Signed and Sealed this

Fourteenth Day of December, 1993

*Attest:*

Bruce Lehman

BRUCE LEHMAN

*Attesting Officer*

*Commissioner of Patents and Trademarks*